US006811464B2

(12) United States Patent
Li

(10) Patent No.: US 6,811,464 B2
(45) Date of Patent: Nov. 2, 2004

(54) BRASSIERE

(75) Inventor: Zhonglin Li, Hong Kong (HK)

(73) Assignee: Regina Miracle International Limited, New Territories (HK)

( * ) Notice: Subject to any disclaimer, the term of this patent is extended or adjusted under 35 U.S.C. 154(b) by 0 days.

(21) Appl. No.: 10/252,360

(22) Filed: Sep. 24, 2002

(65) Prior Publication Data

US 2004/0058617 A1 Mar. 25, 2004

(51) Int. Cl.[7] ..... A41C 3/00
(52) U.S. Cl. ..... 450/57; 450/41; 450/39
(58) Field of Search ..... 450/39, 40, 41, 450/46, 47, 51, 52, 53, 55, 57, 92, 93; 2/267, 255, 258; 264/239, 241, 251, 252, 257, 258, 299, 319–322, 324

(56) References Cited

U.S. PATENT DOCUMENTS 5,472,366 A * 12/1995 Moore ..... 450/41
5,967,877 A * 10/1999 Howard ..... 450/57
6,257,951 B1 * 7/2001 De Marco ..... 450/55
6,435,939 B1 * 8/2002 Lin ..... 450/41
6,447,365 B1 * 9/2002 Powell et al. ..... 450/41

* cited by examiner

*Primary Examiner*—Gloria M. Hale
(74) *Attorney, Agent, or Firm*—Leydig, Voit & Mayer, Ltd.

(57) ABSTRACT

A brassiere cup has two fabric layers, a layer of soft material between the two fabric layers, a foam cup-bottom support made of a material harder than the soft material layer and situated between the two fabric layers adjacent the soft material layer. The brassiere is made, in part, by taking a first pre-laminated sheet of a first fabric layer and a first foam layer and forming a flute in the first foam layer, placing the foam cup-bottom support in the flute, and taking a second pre-laminated sheet of a second fabric layer and a second foam layer and moulding the second foam layer against the first foam layer, encasing the foam cup-bottom support between the first and second fabric layers.

3 Claims, 1 Drawing Sheet

BRASSIERE

BACKGROUND OF THE INVENTION

The present invention relates to brassieres. More particularly, although not exclusively, the invention relates to a laminated brassiere cup having a hard foam support wire.

It is known to produce brassieres from laminated foam. It is also known to provide a wire at the bottom of the cup to provide support. The wire is usually made from metal or other bendable material. Such wire can be uncomfortable and can be deformed plastically when bent beyond its elastic limit. Such might occur for example during washing or other handling.

Also, metallic, or other known hard cup-bottom brassiere wires can protrude from the material from which the brassiere is made after a number of washes.

OBJECTS OF THE INVENTION

It is an object of the present invention to overcome or substantially ameliorate at least one of the above disadvantages and/or more generally to provide improved brassiere cup.

It is a further object of the present invention to provide a method of manufacturing an improved brassiere cup.

DISCLOSURE OF THE INVENTION

There is disclosed herein a brassiere cup comprising:

a pair of fabric layers, a layer of soft material in between the two fabric layers, a foam cup-bottom support wire made of material harder than the soft material layer and situated in between the two fabric layers adjacent the soft material layer.

Preferably the layer of soft material is foam.

There is further disclosed here in a method of fabricating a brassiere cup, the method comprising:

moulding a hard foam wire, taking a first pre-laminated sheet comprising a fabric layer and a foam layer and forming a flute in the foam layer, placing the hard foam wire in the flute, and taking a second pre-laminated sheet comprising a fabric layer and a foam layer and moulding its foam layer against the foam layer of the first laminated sheet and encasing the foam wire between the fabric layers.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 2:
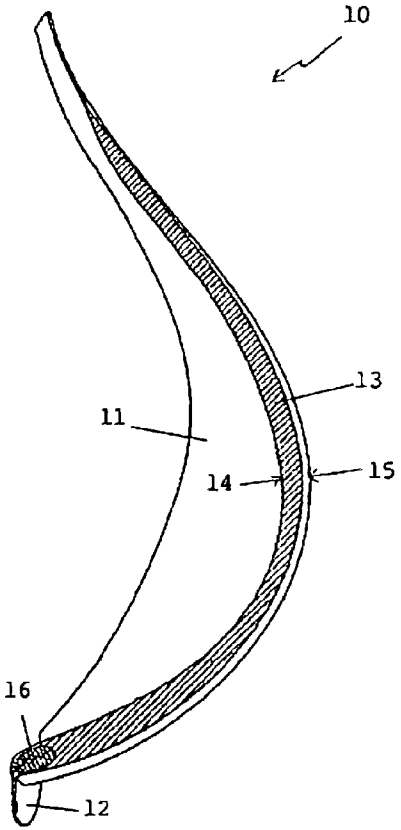
FIG. 2 is a schematic cross-sectional elevational view of the brassiere cup of FIG. 1, taken at II—II in FIG. 1.
Figure 1:
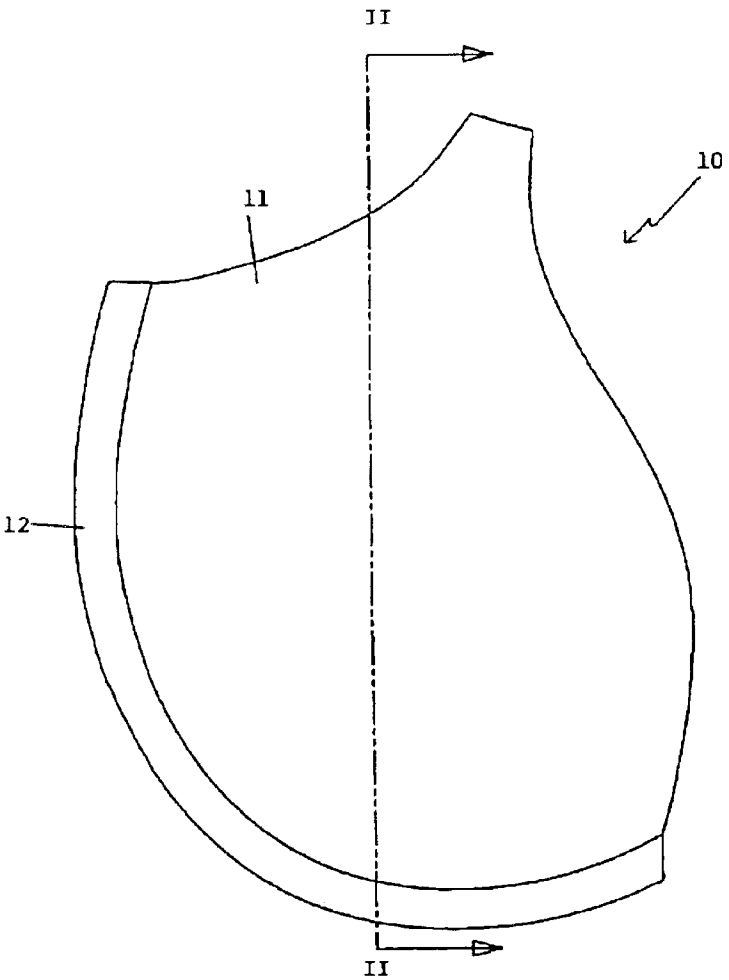
FIG. 1 is a schematic elevational view of a brassiere cup.

In the accompanying drawings there is schematically depicted a brassiere cup 10. Cup 10 includes a breast cup portion 11 and a bottom edge portion 12.

The cup 10 would be stitched or otherwise secured to or formed integrally with a shoulder strap, a side strap and a connecting portion by which the cup 10 would be associated with another cup 10 for the other breast of a wearer.

The cup portion 11 has an inwardly-facing fabric layer 14, a middle soft foam layer 13 and an outwardly facing fabric layer 15.

Adjacent to the bottom edge portion 12, there is located between the fabric layers 14 a hard foam wire 16. This foam wire provides support to the wearer.

The hard foam wire 16 is moulded in a die made of aluminium for example.

A pre-laminated sheet of fabric and soft foam has a channel formed in the soft foam layer. The pre-laminated sheet with the channel is then placed in a rigid mould, with the foam side facing away from the mould. The hard foam wire is then placed in the channel.

A second pre-laminated sheet of fabric and foam is then placed over the first pre-laminated sheet and hard foam wire with its foam layer against the foam layer of the first pre-laminated sheet.

The second sheet is then pressed by a breast-shaped former against the first sheet and the two sheets are moulded together. As a result, the hard foam 16 is laminated between the fabric layers 14 and 15 adjacent to the melded soft foam core 13.

Heat may be applied to assist the melding process, or alternatively, one or both of the soft foam layers of the pre-laminated sheets can have adhesive applied thereto prior to pressing them together.

After removal from the mould, the brassiere cup 10 can then be trimmed to shape with a knife or other cutting implement.

The hard foam material can be chosen from any substantially non-stretchable synthetic material that is capable of bending elastically.

It should be appreciated that modifications and alterations obvious to those unskilled in the art are not to be considered as beyond the scope of the present invention. For example, the hard foam wire might be glued into the channel. Also, instead of pressing a breast-shaped former into a concave mould, the first sheet with the channel and hard wire might be placed over a breast-shaped former and the other sheets placed thereover prior to pressing by a concave part

What is claimed is:

1. A brassiere cup comprising:

two fabric layers, a layer of soft material between the two fabric layers, a cup-bottom foam support made of a foam material harder than the layer of soft material and situated directly between and in direct surface contact with the two fabric layers adjacent the layer of soft material.

2. The brassiere cup of claim 1, wherein the soft material is a foam material.

3. A method of fabricating a brassiere cup, the method comprising:

moulding a cup-bottom hard foam support, taking a first pre-laminated sheet comprising a first fabric layer and a first foam layer softer than the cup-bottom hard foam support and forming a flute in the first foam layer, placing the cup-bottom hard foam support in the flute, and taking a second pre-laminated sheet comprising a second fabric layer and a second foam layer and moulding the second foam layer against the first foam layer of the first pre-laminated sheet, thereby encasing the cup-bottom hard foam support between the first and second fabric layers.

* * * * *